US011690411B2

(12) United States Patent
Ironi

(10) Patent No.: US 11,690,411 B2
(45) Date of Patent: Jul. 4, 2023

(54) BREAST SUPPORT GARMENT WITH ADJUSTABLE FIT

(71) Applicant: The Dairy Fairy, Inc., Belmont, CA (US)

(72) Inventor: Emily Ironi, San Jose, CA (US)

( * ) Notice: Subject to any disclaimer, the term of this patent is extended or adjusted under 35 U.S.C. 154(b) by 0 days.

(21) Appl. No.: 17/030,296

(22) Filed: Sep. 23, 2020

(65) Prior Publication Data

US 2021/0084996 A1 Mar. 25, 2021

Related U.S. Application Data

(60) Provisional application No. 63/024,507, filed on May 13, 2020, provisional application No. 62/904,535, filed on Sep. 23, 2019.

(51) Int. Cl.

| | |
|---|---|
| ***A41C 3/04*** | (2006.01) |
| ***A41C 3/12*** | (2006.01) |
| ***A41D 1/215*** | (2018.01) |

(52) U.S. Cl.

CPC ..... *A41C 3/04* (2013.01); *A41C 3/12* (2013.01); *A41D 1/215* (2018.01)

(58) Field of Classification Search

USPC ..... 450/36; 2/69

See application file for complete search history.

(56) References Cited

U.S. PATENT DOCUMENTS

| | | | | |
|---|---|---|---|---|
| 2,679,048 A | | 5/1954 | Alberts | |
| 3,378,013 A | | 4/1968 | Enrico | |
| 3,513,852 A | * | 5/1970 | Seidl | A41C 3/04 450/39 |
| 4,390,024 A | * | 6/1983 | Williams | A41C 3/04 450/36 |
| 4,648,404 A | * | 3/1987 | Clark | A41C 3/04 2/104 |
| 4,878,879 A | * | 11/1989 | Kunstadter | A41C 3/04 223/111 |
| 5,180,326 A | | 1/1993 | Williams | |
| 5,221,227 A | | 6/1993 | Michels | |
| 5,378,192 A | | 1/1995 | Darmante | |
| 5,749,768 A | | 5/1998 | Green | |
| 5,839,942 A | | 11/1998 | Miller | |
| 6,068,538 A | | 5/2000 | Alleyne | |
| 6,227,936 B1 | | 5/2001 | Mendoza | |
| 6,974,361 B2 | | 12/2005 | Cravaack | |
| 6,983,489 B2 | | 1/2006 | Caprio | |
| 7,056,186 B1 | | 6/2006 | Weyenberg | |
| 7,448,090 B2 | | 11/2008 | Lucock | |

(Continued)

*Primary Examiner* — Timothy K Trieu

(74) *Attorney, Agent, or Firm* — Scarpati Intellectual Property, LLC; Jennifer N. Scarpati

(57) ABSTRACT

A brassiere having a pair of breast cups, shoulder straps and a chest band, wherein each of the breast cups can be attached to the shoulder straps using one of a plurality of fasteners, most typically standard nursing clips, with each fastener providing for a different fit. A first fastener could be attached directly to the breast cup and used to provide a snug fit, while a second fastener could be attached to the breast cup via an extension which provides a much looser fit. Using the second extended fastener would, for example, allow the bra to be used with an in-bra breast pump. The first fastener could be used to fit the bra properly when the in-bra breast pump is not in place.

2 Claims, 10 Drawing Sheets

(56) References Cited

U.S. PATENT DOCUMENTS

| | | | | |
|---|---|---|---|---|
| 7,448,937 | B2 | 11/2008 | Weyenberg | |
| 7,497,760 | B2 | 3/2009 | Redenius | |
| D597,278 | S | 8/2009 | Cavosie | |
| 7,950,980 | B2 * | 5/2011 | Solberg | A61M 1/062 450/36 |
| 8,123,587 | B2 | 2/2012 | Liegey | |
| 8,137,153 | B2 | 3/2012 | Bell | |
| 8,192,247 | B2 | 6/2012 | Abbaszadeh | |
| 8,307,463 | B2 | 11/2012 | Ritchie | |
| 8,323,070 | B2 | 12/2012 | Abbaszadeh | |
| 8,469,770 | B2 | 6/2013 | Alva | |
| 8,651,917 | B2 | 2/2014 | Lopez | |
| 8,668,547 | B2 | 3/2014 | Boonen | |
| 8,668,549 | B2 | 3/2014 | Solotoff | |
| 8,840,441 | B2 | 9/2014 | Sporn | |
| 9,332,789 | B2 | 5/2016 | Campbell | |
| 2008/0022434 | A1 | 1/2008 | Adelman | |
| 2008/0064299 | A1 | 3/2008 | La Fontaine | |
| 2010/0159802 | A1 | 6/2010 | Abbaszadeh | |
| 2011/0092134 | A1 | 4/2011 | Alva | |
| 2011/0237156 | A1 | 9/2011 | Boonen | |
| 2011/0314587 | A1 | 12/2011 | Ritchie | |
| 2012/0021669 | A1 | 1/2012 | Johnstone | |
| 2013/0095727 | A1 | 4/2013 | Abbaszadeh | |
| 2013/0122780 | A1 | 5/2013 | McCall | |
| 2014/0017978 | A1 | 1/2014 | Campbell | |
| 2018/0352884 | A1 * | 12/2018 | Vanos | A41F 1/006 |
| 2019/0014829 | A1 | 1/2019 | Kim | |

* cited by examiner

BREAST SUPPORT GARMENT WITH ADJUSTABLE FIT

RELATED APPLICATIONS

This application claims priority from U.S. Provisional Application No. 63/024,507, filed May 13, 2020, for "BREAST SUPPORT GARMENT WITH ADJUSTABLE FIT" by Emily Ironi, and from U.S. Provisional Application No. 62/904,535, filed Sep. 23, 2019, for "BREAST SUPPORT GARMENT WITH ADJUSTABLE FIT" by Emily Ironi, each disclosure of which is hereby incorporated herein by reference in its entirety. In addition, all documents and references cited herein and in the above referenced applications, are hereby incorporated herein by reference.

TECHNICAL FIELD OF THE INVENTION

This invention relates to a breast support garment and more particularly, but not by way of limitation, to a brassiere for nursing women where the fit of the bra cups can be adjusted to accommodate in-bra breast pump.

BACKGROUND OF THE INVENTION

It is generally well-known breast milk provides the best nourishment for a growing baby. It is a natural and beneficial source of nutrition providing the healthiest start for an infant. It also promotes a unique and emotional connection between mother and baby. In fact, the American Academy of Pediatrics (AAP) recommends exclusive breastfeeding for a minimum of six (6) months of a baby's life and breastfeeding in combination with the introduction of complementary foods until at least twelve (12) months of age, and continuation of breastfeeding for as long as mutually desired by mother and baby.

It is also well known that breastfeeding comes with many challenges, particularly for working women. It is for this reason The Patient Protection and Affordable Care Act passed by Congress in March 2010 mandates that employers provide "reasonable break time" for nursing mothers and private non-bathroom areas to express breast milk during their workday.

One tool often used to assist with the expression of breast milk, is a mechanical device commonly known as a breast pump. A breast pump is designed to suction the milk from the breasts via a flange attachment connected to a collection container or bottle. A breast pump therefore provides a convenient means through which a woman may extract and store breast milk for later use. While convenient, the use of a breast pump is still a time-consuming process which can be made more efficient with the advent of wearable products designed to support hands-free pumping. Wearable breast pumps fit largely within a wearer's bra, which allows for more discrete pumping, but positioning such a wearable breast pump inside the bra requires the fit of the bra to be adjusted, which is not easily accomplished using prior art bras or other breast support garments.

What is needed is a breast support garment that overcomes the disadvantages of the prior art. There exists a need for a bra or other breast support garment for nursing women that easily adjusts in size to accommodate wearable breast pumps that to sit inside a woman's bra.

SUMMARY OF THE INVENTION

Embodiments of the present invention are directed to a breast support garment, such as a brassiere, having a pair of breast cups, shoulder straps and a chest band, wherein each of the breast cups can be attached to the shoulder straps using one of a plurality of fasteners, with each fastener providing for a different fit. In various embodiments, the invention can be embodied in the form of a bra, camisole, tank top, dress, or shirt.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

The accompanying drawings are not intended to be drawn to scale. In the drawings, each identical or nearly identical component that is illustrated in various figures is represented by a like numeral. For purposes of clarity, not every component may be labeled in every drawing.

DETAILED DESCRIPTION OF EMBODIMENTS

Embodiments of the present invention are directed to a brassiere having a pair of breast cups, shoulder straps and a chest band, wherein each of the breast cups can be attached to the shoulder straps using one of a plurality of fasteners, most typically standard nursing clips, with each fastener providing for a different fit. In some embodiments, for example, a first fastener could be attached directly to the breast cup and used to provide a snug fit, while a second fastener could be attached to the breast cup via an extension which provides a much looser fit. Using the second extended fastener would, for example, allow the bra to be used with an in-bra breast pump. The first fastener could be used to fit the bra properly when the in-bra breast pump is not in place.

As described herein, any fastener, clasp, or connection can be made using any suitable connection mechanisms that are generally available and conventional in the art and may include but are not limited to connector structures such as hooks and corresponding connector slots, stitches, holes, eyelets, links, or loops for adjustable closure. Further, the term "attached" as used herein, can mean directly fastened to, attached indirectly using another structural element, and/or integrally formed as a part of.

Figure 1:
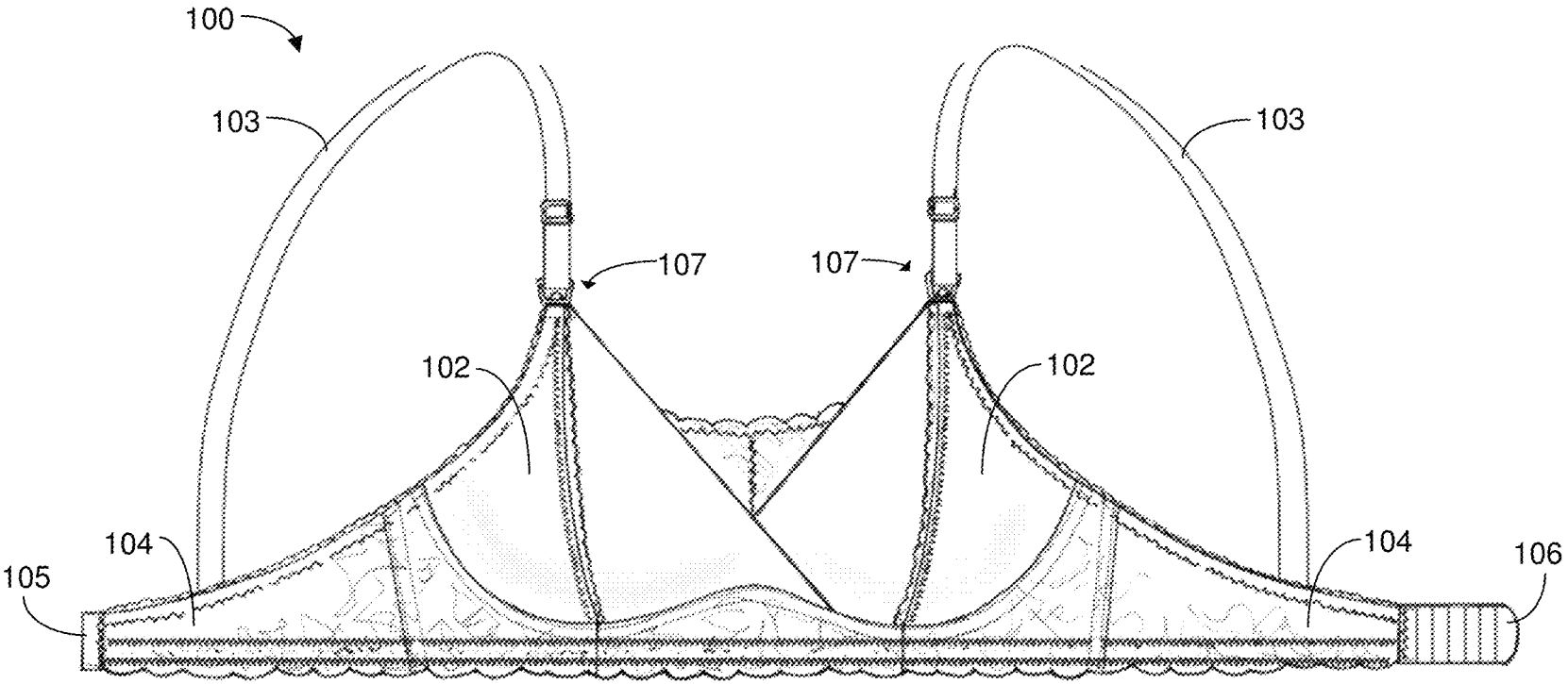
FIG. 1 is an outer view of an embodiment of the invention.
Figure 2:
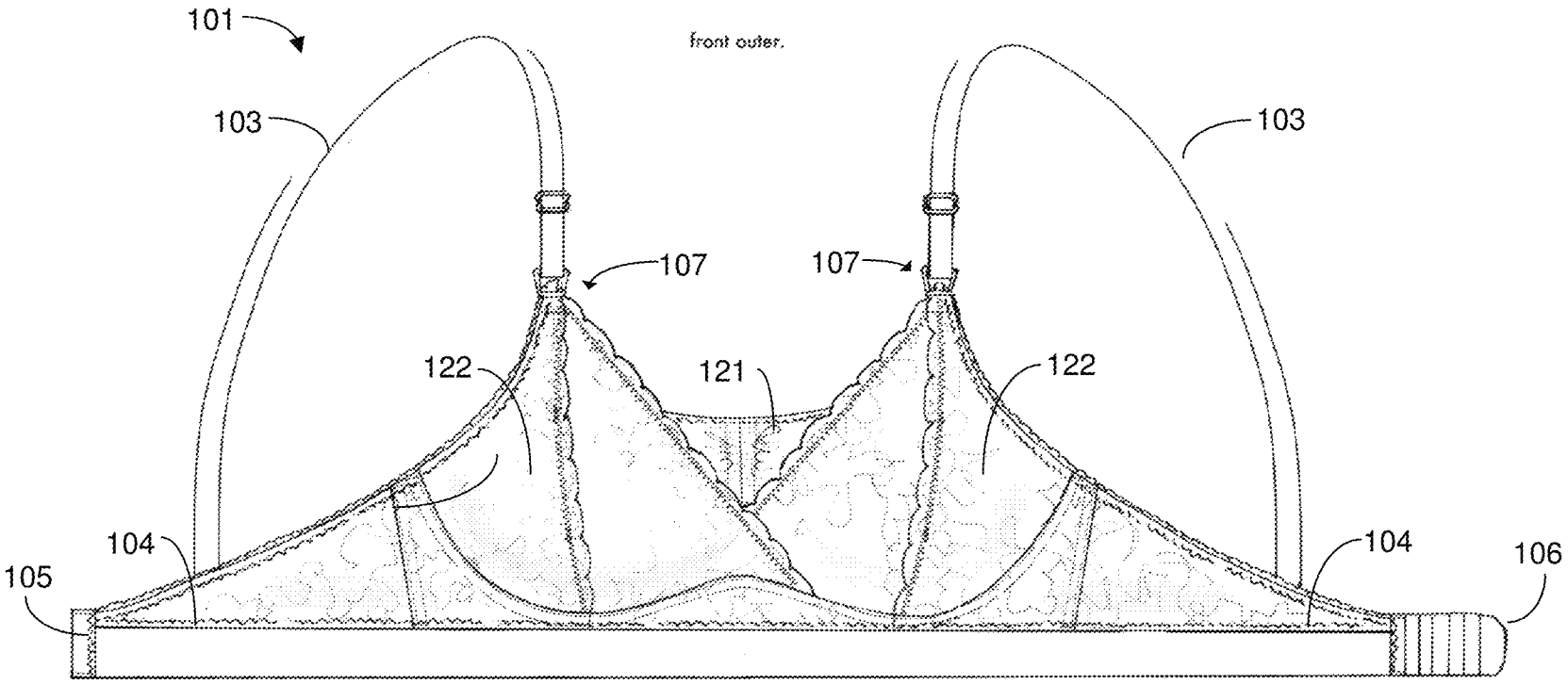
FIG. 2 is an outer view of another embodiment of the invention.

FIG. 1 is a drawing of a brassier according to an embodiment. FIG. 2 is a drawing of another embodiment of a brassier. The brassieres of FIG. 1 and FIG. 2 each comprise a pair of breast cups 102, shoulder straps 103, and chest band 104. Chest band 104 wraps around a wearer's torso to hold the bra in place. In some embodiments, chest band 104 can be formed from or lined with a comfortable fabric such as a microfiber and has fasteners at the back to connect the two ends (105, 106) of the chest band. In other embodiments fasteners can be located at the front, between the breast cups. In other embodiments, the two opposite ends of the chest band wrap completely around the body of the wearer and are fastened in place in the front of the garment using a VELCRO fastener or other suitable fastener type. Such an arrangement is shown, for example, in U.S. Prov. Pat. App. 63/023,879 to Emily Ironi for "Breast Support Garment," which is assigned to the assignee of the present application and is hereby incorporated by reference. In other embodiments, the brassier can have an elastic band with no fasteners that can be pulled on over a wearer's head.

Figure 5:
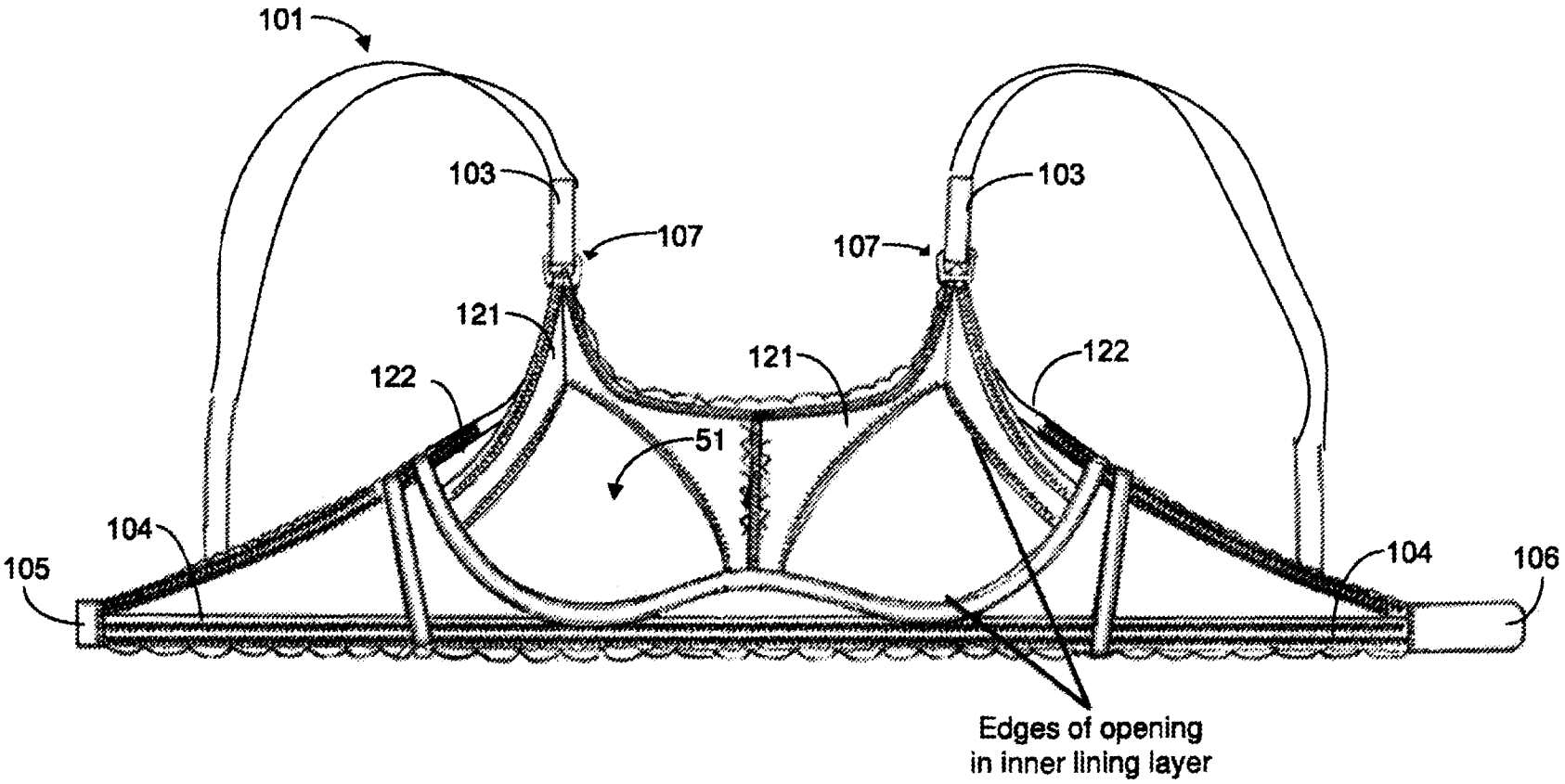
FIG. 5 is an inner view of an embodiment with an inner lining layer and an outer layer.

The breast cups 102 can be attached via a detachable first clasp 107 at an upper portion to the shoulder straps 103 to hold the cups in place over a wearer's breasts. FIG. 5 is an inner view of an embodiment where the breast cups 102 comprise at least two layers—an inner lining layer 121 and an outer layer 122. The inner lining layer 121 only partially covers the wearer's breasts and has openings 51 in each breast cup that leaves the nipples exposed for breast feeding and/or pumping. In some embodiments the inner layer is not detachable from first clasp 107. The outer layer 122 can be attached and detached via first clasp 107. Because the inner lining layer 121 does not cover the wearer's nipples, disconnecting the outer layer fastener allows the breast cup outer layer to fold down to expose the inner layer (which does not cover the wearer's nipple) allow nursing and/or pumping. Such an arrangement is shown, for example, in U.S. Design Pat. D854,782 to Emily Ironi for "Nursing Bra," which is assigned to the assignee of the present application and is hereby incorporated by reference. The term "outer layer" will be used herein to refer to any layer or combination of layers that can be folded down to expose the wearer's nipples, even in a breast cup that only comprises a single layer (i.e., without in inner lining layer).

Figure 11:
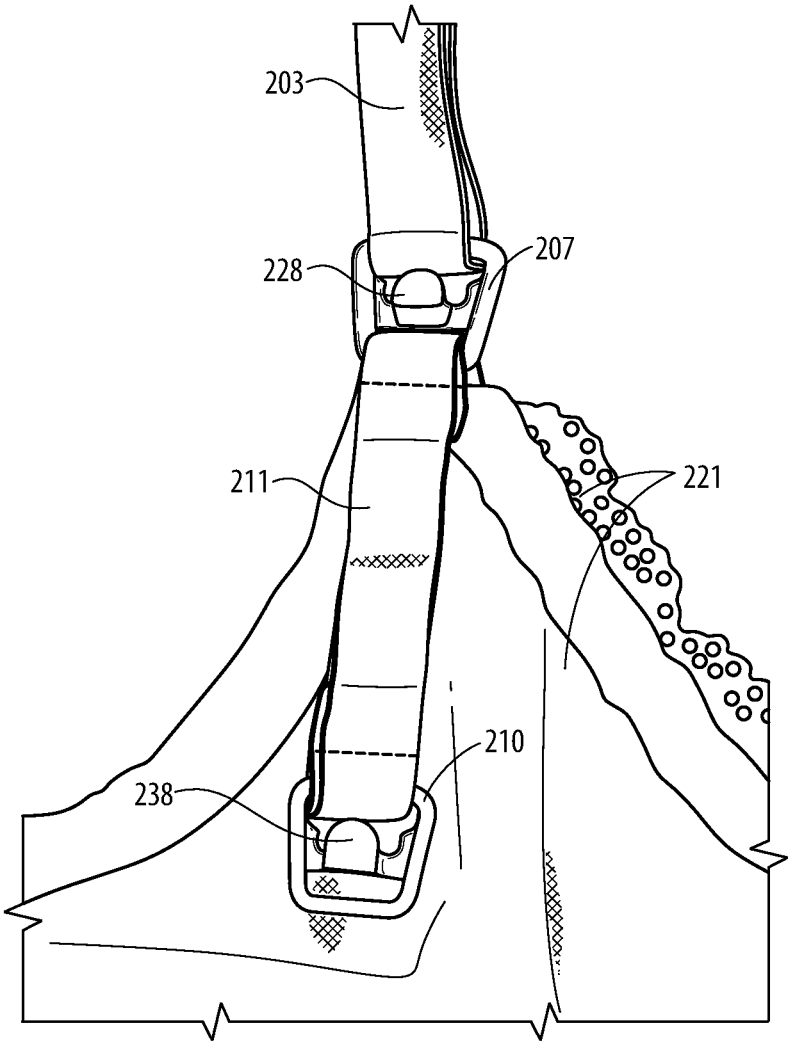
FIG. 11 is a detail view of the top edge of a breast cup inner lining layer according to another embodiment.
Figure 12:
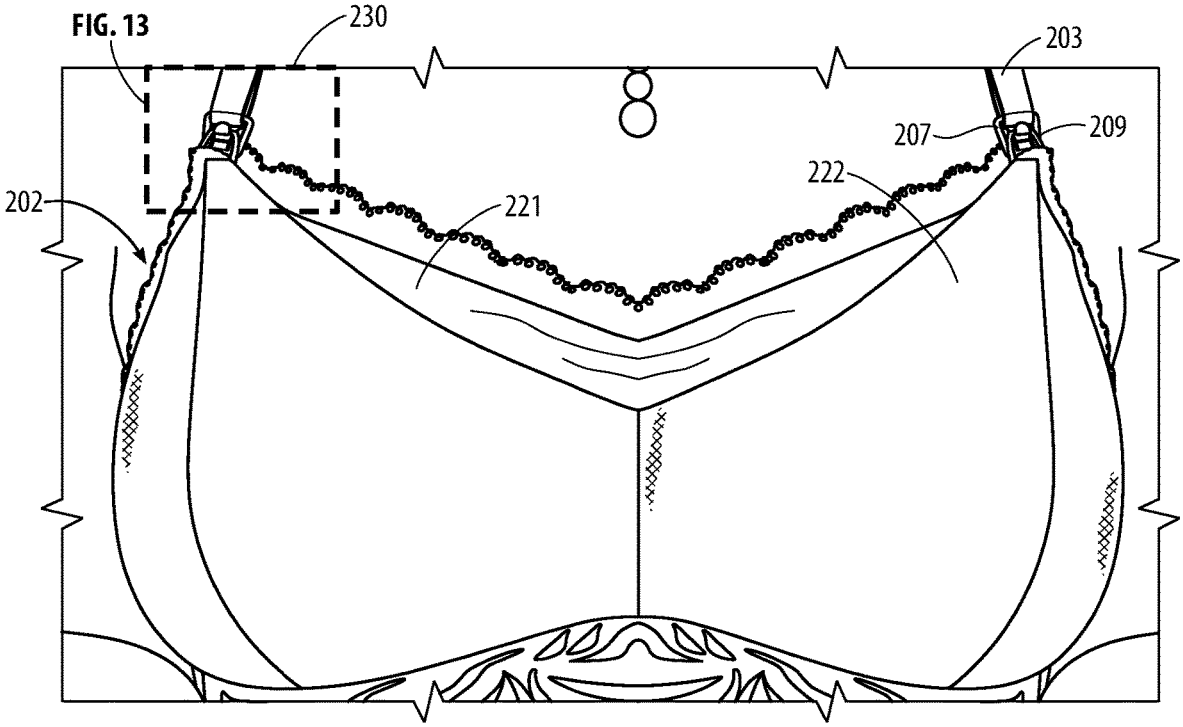
FIG. 12 is an outer view of the embodiment of FIG. 11
Figure 13:
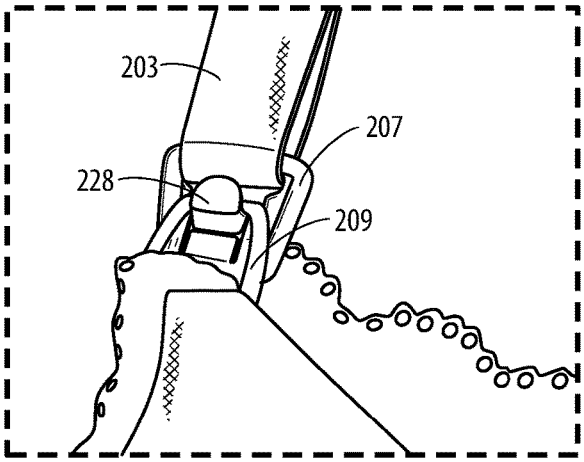
FIG. 13 is a detail view of FIG. 12 showing two connected fastener components.

First clasp 107, as well as each of the other clasps described herein with respect to any embodiment, can be any suitable fastener, such as a button, snap, clip, or hook. In some embodiments, first clasp 107 is a two-part fastener, such as a standard nursing clip, with an upper clasp portion 108 attached to the front end of each shoulder strap 103. Referring also to FIG. 11, in an embodiment with breast cups having two or more layers, a lower clasp portion 118 of first clasp 107 can be attached to an upper portion of inner lining layer 121, which is also connected to chest band 104 so that the bra will remain in place on the wearer's body when the breast cup outer layer is disconnected (such as to allow nursing).

Figure 3:
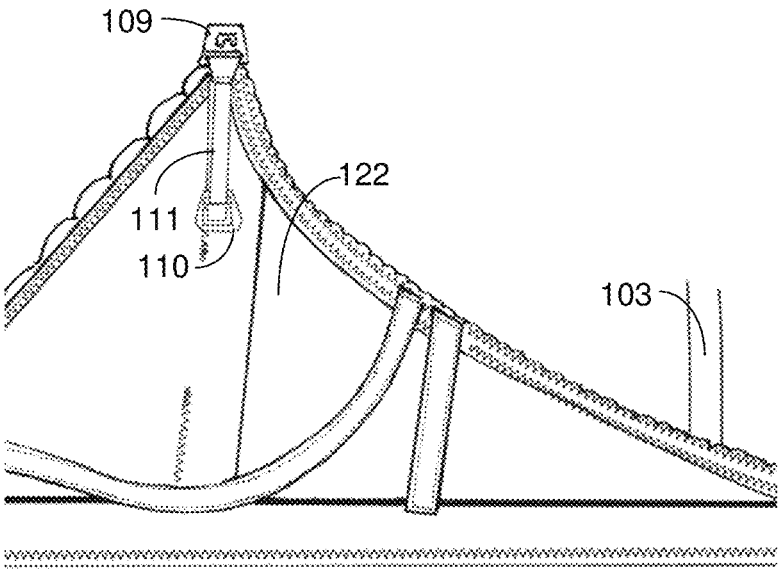
FIG. 3 is a detail inner view of the top edge of a breast cup according to an embodiment with the clasps both unfastened from the shoulder strap.
Figure 9:
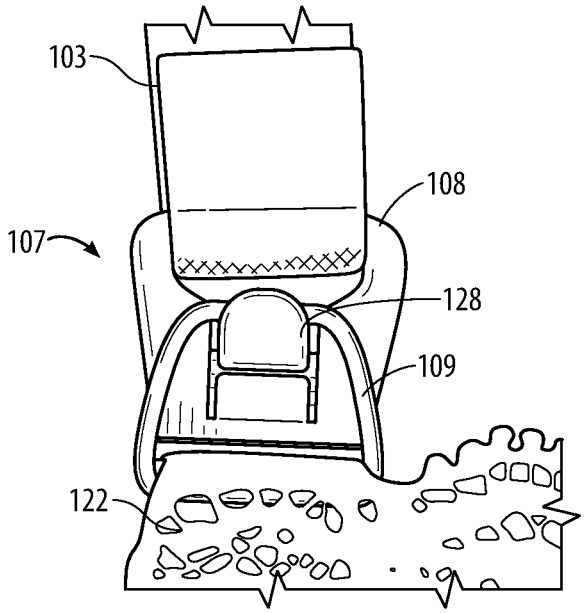
FIG. 9 shows a nursing clip fastener suitable for practicing embodiments of the invention.
Figure 10:
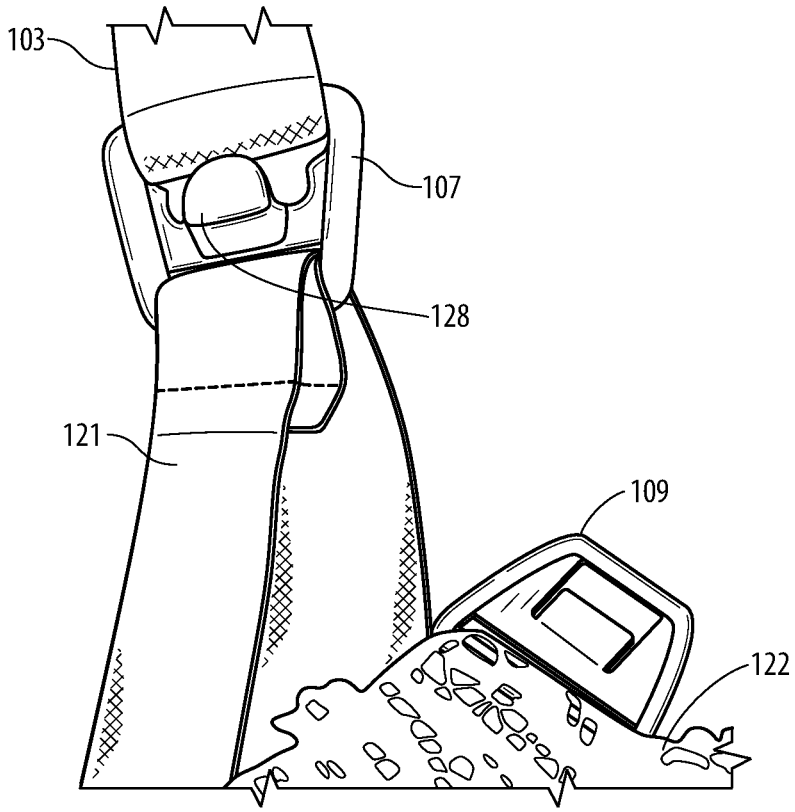
FIG. 10 shows the fastener of FIG. 9 with the two fastener components disconnected.

As shown in FIGS. 1-3, a second clasp 109 can be directly attached to an upper portion of an outer layer of one or both of breast cups 102 (although other suitable attachment locations could be used) so that the second clasp 1099 can be attached to the central clip portion 128 of first clasp 107. In this fashion, the clasps can also be easily disconnected (while the garment is being worn) to allow a nursing mother to fold the breast cup outer layer down for nursing an infant. In some embodiments where the breast cups comprise at least two layers (as described above) a second clasp 109 can be directly attached to the top edge of the outer layer 122. FIGS. 9 and 10 show nursing clip fasteners suitable for practicing embodiments of the invention.

Figure 4:
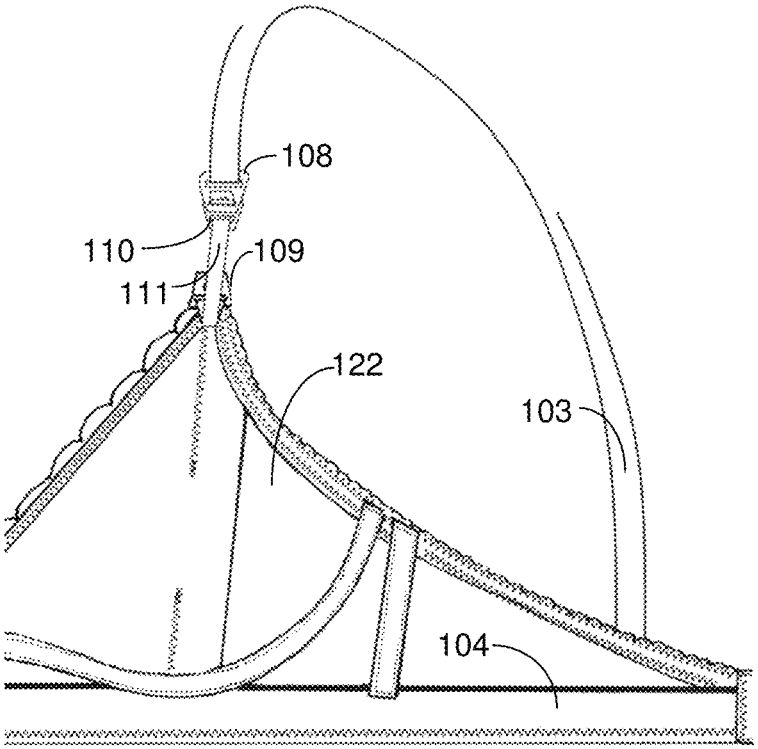
FIG. 4 is a detail view of the top edge of a breast cup according to an embodiment with the extension clasp fastened to the bra strap.

Referring also to FIGS. 3-4, a third clasp 110 can be attached to a strap extending from the breast cup outer layer. Third clasp 110 (also referred to as the extension clasp) can be attached to an extension strap 111 extending from the top portion of the breast cup (or any other suitable location). In some embodiments, third clasp 110 is a two-part fastener, such as a standard nursing clip, with a lower clasp portion 118 attached to the unattached end of extension strap 111. Third clasp 110 can be attached (or detached) from the clip portion of first clasp 110/. In accordance with an aspect of the invention, the first and third clasps can be attached together (instead of the first and second clasps) to adjust the fit of the breast cup. Third clasp 110 can be attached to first clasp 107 so that when the third clasp 110 is attached (instead of the second clasp 109) the fit of the breast cup 102 (or the fit of the breast cup outer layer for embodiments with two or more layers) will be significantly looser than if the second clasp were used.

Figure 8:
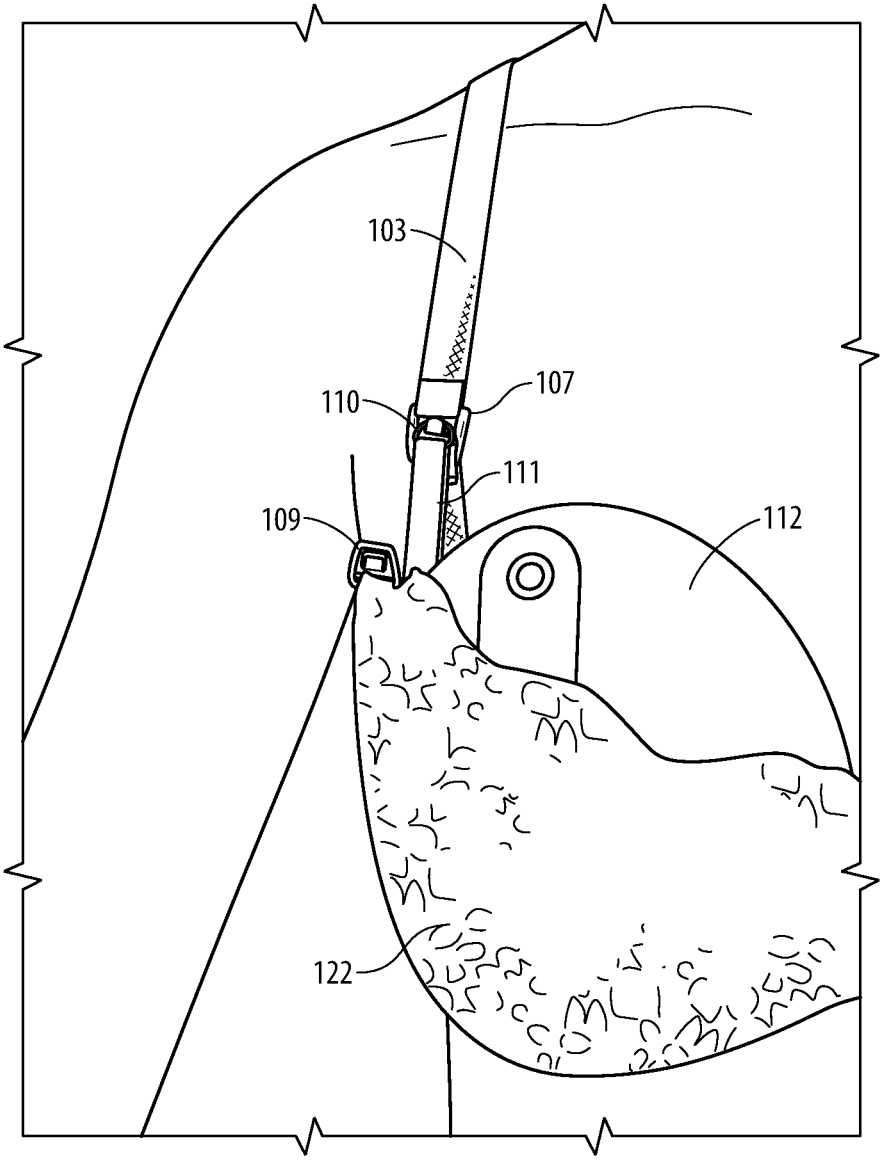
FIG. 8 shows an embodiment according to the invention with the extension clasp fastened to provide room for an in-bra (wearable) breast pump.

This looser fit allows, for example, room for an in-bra breast pump 112 (as shown in FIG. 8) to be worn over the wearer's breast. Attaching the breast cup via second clasp 109, in contrast, allows for a tighter fit. This tighter fit, for example, allows the breast cup to fit properly over the wearer's breast when an in-bra breast pump is not being used. In some embodiments, the in-bra breast pump can be worn over the inner lining layer 121 (which allows access to the wearer's nipple) and under the outer layer 122.

The use of extension straps according to embodiments of the invention allows a wearer to quickly adjust the fit of each breast cup between two sizes without adjusting the overall length of the bra straps. Further, the adjustment between sizes can be easily accomplished while the bra is worn, without requiring the wearer to get partially undressed. In some embodiments, additional extension straps or clasp attachment points can be used to provide additional size adjustments.

Figure 6:
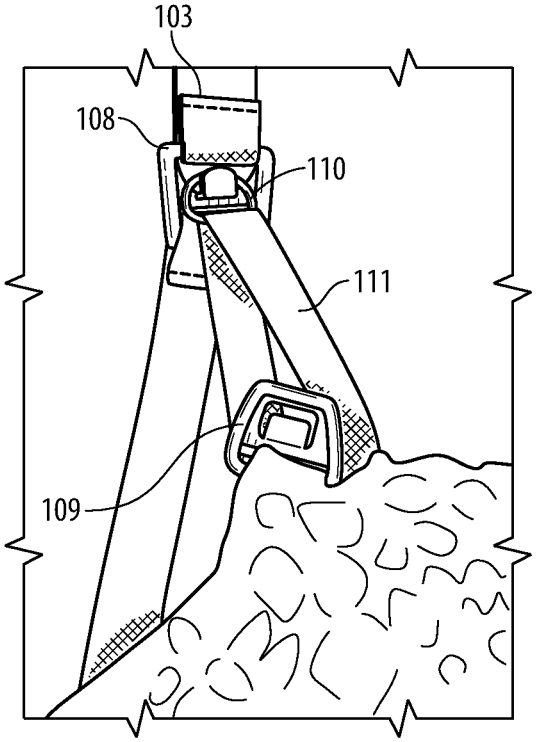
FIG. 6 shows another embodiment of a breast cup with the main clasps unfastened and using the extender to create the additional space.
Figure 7:
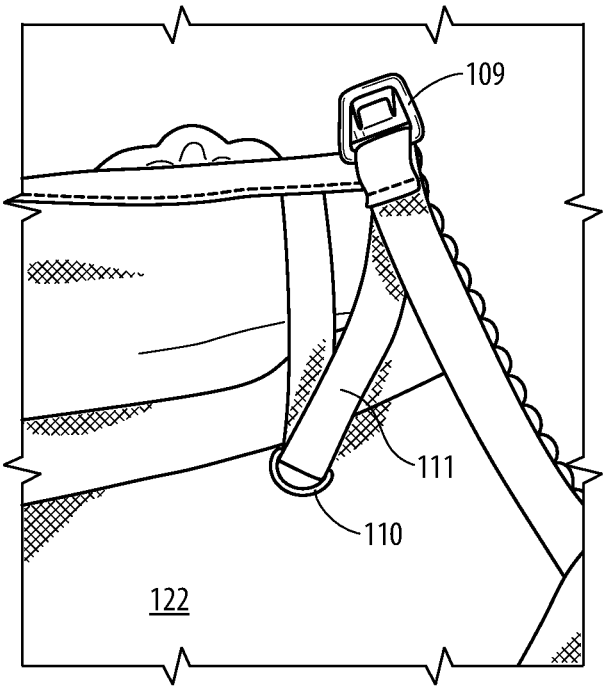
FIG. 7 shows another embodiment of a breast cup with the extension clasp unfastened to the bra strap and recessed into the inner breast cup.

Extension strap 111 can be made from an elastic/stretchy material or a non-elastic material. As shown in FIGS. 6 and 7, in some embodiments the extension strap can be looped (i.e. to create a V shape) and sewn into the right and left of the inner part of the top of the cup, with the extension clasp 108 capable of being moved along the looped strap to provide for a more adjustable fit. In some embodiments, the length of the extension strap and/or the amount of extension provided by using the extension clasps can be adjusted to a desired fit. In some embodiments, for example, using the extension clasp will provide between ½"-3" of extension.

FIGS. 11-14 show an embodiment where the extension strap extends from the front end of the shoulder strap (instead of from the top of the breast cup as described above). FIG. 11 is detail view of the top edge of a breast cup inner lining layer with the extension strap extending from the seam of the top of the breast cup inner lining layer with a fastener at the unattached end of the extension strap. Like the embodiments described above, the brassier of FIGS. 11-14 comprises a pair of breast cups 202, shoulder straps 203, and chest band 204. Chest band 204 wraps around a wearer's torso to hold the bra in place. In some embodiments, chest band 204 can be formed from or lined with a comfortable fabric such as a microfiber and has fasteners at the back to connect the two ends (205, 206) of the chest band. In other embodiments fasteners can be located at the front, between the breast cups. In other embodiments, the two opposite ends of the chest band wrap completely around the body of the wearer and are fastened in place in the front of the garment using a VELCRO fastener or other suitable fastener type.

The breast cups 202 can be attached via a detachable first clasp 207 at an upper portion to the shoulder straps 203 to hold the cups in place over a wearer's breasts. In some embodiments, the breast cups 202 comprise at least two layers—an inner lining layer 221 and an outer layer 222. The inner lining layer 221 only partially covers the wearer's breasts and leaves the nipples exposed for breast feeding and/or pumping. In some embodiments the inner layer is not detachable from first clasp 207. The outer layer 222 can be attached and detached via first clasp 207. Because the inner lining layer 221 does not cover the wearer's nipples, disconnecting the outer layer fastener allows the breast cup outer layer to fold down to expose the inner layer (which does not cover the wearer's nipple) allow nursing and/or pumping.

First clasp 207 can be any suitable fastener, such as a button, snap, clip, or hook. In some embodiments, first clasp 207 is a two-part fastener, such as a standard nursing clip, with an upper clasp portion 208 attached to the front end of each shoulder strap 203. In an embodiment with breast cups having two or more layers, a lower clasp portion 218 of first clasp 207 can be attached to an upper portion of inner lining layer 221, which is also connected to chest band 204 so that the bra will remain in place on the wearer's body when the breast cup outer layer is disconnected (such as to allow nursing).

A second clasp 209 can be directly attached to an upper portion of an outer layer of one or both of breast cups 202 (although other suitable attachment locations could be used) so that the second clasp can be attached to the central clip portion 228 of first clasp 207. In this fashion, the clasps can also be easily disconnected (while the garment is being worn) to allow a nursing mother to fold the breast cup outer layer down for nursing an infant. In some embodiments where the breast cups comprise at least two layers (as described above) second clasp 209 can be directly attached to the top edge of the outer layer 222.

Figure 14:
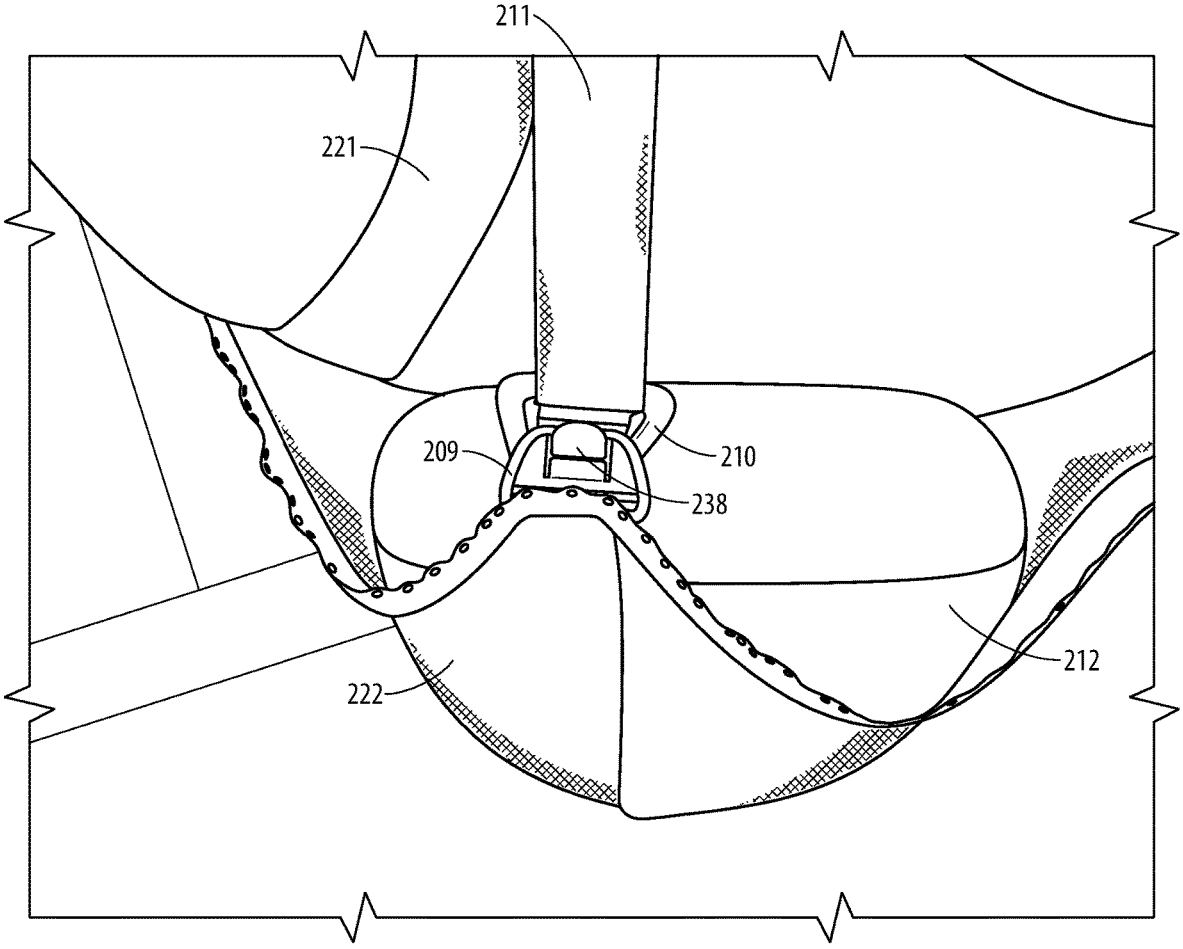
FIG. 14 shows the embodiment of FIG. 11 with the extension clasp fastened to provide room for an in-bra (wearable) breast pump.

In some embodiments, a third clasp 210 can be attached to an extension strap 211 extending from the lower portion 218 of first clasp 207. In other embodiments, extension strap 211 can extend from the upper or top edge of the inner breast cup layer 221 or any other suitable attachment point near where the first clasp is located. In some embodiments, third clasp 210 is a two-part fastener, such as a standard nursing clip, with an upper clasp portion 208 attached to the unattached end of extension strap 211. Second clasp 209 can be attached (or detached) from the clip portion 238 of third clasp 210. In accordance with an aspect of the invention, the second and third clasps can be attached together (instead of the first and second clasps) to adjust the fit of the breast cup. When second clasp 209 is attached to the third clasp 210 (instead of the first clasp 207) the fit of the breast cup 202 (or the fit of the breast cup outer layer 222 for embodiments with two or more layers) will be significantly looser than if the first clasp were used. FIG. 14 shows such an embodiment with the second clasp 209 fastened to the extension clasp (the third clasp 210) fastened to provide room for an in-bra (wearable) breast pump 212.

Extension strap 211 also can be made from an elastic/stretchy material or a non-elastic material. In some embodiments the extension strap can be looped (i.e. to create a V shape) and sewn into the right and left of the top of the breast cup inner lining, with the extension clasp 208 capable of being moved along the looped strap to provide for a more adjustable fit. In other embodiments, the extension strap can extend from the seam at the top of the breast cup inner lining and end with a clasp or connector that is stitched in. In some embodiments, the length of the extension strap and/or the amount of extension provided by using the extension clasps can be adjusted to a desired fit.

The invention described herein has broad applicability and can provide many benefits as described and shown in the examples above. The embodiments will vary greatly depending upon the specific application. Not every embodiment will provide all the benefits and meet all the objectives that are achievable by the invention.

In the discussion and in the claims, the terms "including" and "comprising" are used in an open-ended fashion, and thus should be interpreted to mean "including, but not limited to . . . ." To the extent that any term is not specially defined in this specification, the intent is that the term is to be given its plain and ordinary meaning. The accompanying drawings are intended to aid in understanding the present invention and, unless otherwise indicated, are not drawn to scale. As used herein, the terms "front" and "back" will refer to the respective sides of a wearer's body when the garment is being worn. Otherwise, descriptive terms such as "right," "left," "lower," "upper," "bottom," "horizontal," "vertical," "outer," "inner," and the like designate directions in the drawings to which reference is made. These terms are used for convenience only and are not limiting.

The scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps. The figures described herein are generally schematic and do not necessarily portray the embodiments of the invention in proper proportion or scale.

What is claimed is:

1. A nursing garment comprising: a pair of breast support cups;

a chest band for securing the garment to the torso of a person wearing the garment, the chest band attached to a lower portion of each breast support cup;

a pair of shoulder straps, a back portion of each shoulder strap attached to the chest band and a front portion of each shoulder strap terminating in a first clasp;

a pair of second clasps, each second clasp attached to an upper portion of each breast support cup;

a pair of extension straps, each extension strap attached to the upper portion of each breast support cup, each extension strap extending beyond the second clasp attached to the upper portion of each breast support cup, wherein a portion of each extension strap extending beyond the second clasp terminates in a third clasp;

wherein the first and second clasps are adapted to attach together such that each breast support cup fits snugly around an underlying breast, and the first and third clasps are adapted to attach together such that each breast support cup fits loosely to permit the insertion of a breast pump between the breast support cup and the underlying breast.

2. A nursing garment comprising: a pair of breast support cups;

a chest band for securing the garment to the torso of a person wearing the garment, the chest band attached to the lower portion of each breast support cup;

a pair of shoulder straps, a back portion of each shoulder strap attached to the chest band and a front portion of each shoulder strap terminating in a first clasp;

a pair of second clasps, each second clasp attached to an upper portion of each breast support cup;

a pair of extension straps, each extension strap attached adjacent to the first clasp, each extension strap having an unattached end extending beyond the first clasp toward each second clasp, wherein each unattached end of the extension strap terminates in a third clasp;

wherein the first and second clasps are adapted to attach together such that each breast support cup fits snugly around an underlying breast, and the second and third clasps are adapted to attach together such that each breast support cup fits loosely to permit the insertion of a breast pump between the breast support cup and the underlying breast.

* * * * *